US011445287B2

(12) United States Patent
Mihara et al.

(10) Patent No.: US 11,445,287 B2
(45) Date of Patent: Sep. 13, 2022

(54) SOUND OUTPUT DEVICE

(71) Applicant: SONY CORPORATION, Tokyo (JP)

(72) Inventors: Ryota Mihara, Tokyo (JP); Yasuhide Hosoda, Kanagawa (JP); Ken Tanaka, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/069,794

(22) PCT Filed: Dec. 27, 2016

(86) PCT No.: PCT/JP2016/088981
§ 371 (c)(1),
(2) Date: Jul. 12, 2018

(87) PCT Pub. No.: WO2017/134968
PCT Pub. Date: Aug. 10, 2017

(65) Prior Publication Data

US 2019/0037296 A1 Jan. 31, 2019

(30) Foreign Application Priority Data

Feb. 1, 2016 (JP) ..... JP2016-017271

(51) Int. Cl.
*H04R 1/10* (2006.01)
*H04R 5/033* (2006.01)

(52) U.S. Cl.
CPC ..... *H04R 1/105* (2013.01); *H04R 1/1016* (2013.01); *H04R 1/1041* (2013.01);
(Continued)

(58) Field of Classification Search
CPC .... H04R 1/105; H04R 1/1016; H04R 1/1041; H04R 1/1058; H04R 5/0335; H04R 2420/07; H04R 2460/09
(Continued)

(56) References Cited

U.S. PATENT DOCUMENTS 5,459,290 A * 10/1995 Yamagishi ..... H04R 1/1075 181/129
6,009,183 A * 12/1999 Taenzer ..... H04R 1/105 381/330

(Continued)

FOREIGN PATENT DOCUMENTS

CN 102986245 A 3/2013
CN 106233748 A 12/2016

(Continued)

OTHER PUBLICATIONS

Yoshino, Masaharu and Mihara, Ryota, "Description WO2016067754", May 6, 2016, Patent Translate by EPO and Google, Machine Translation of the WO 2016/067754 Publication, pp. 1-33. (Year: 2016).*

(Continued)

*Primary Examiner* — Daniel R Sellers
(74) *Attorney, Agent, or Firm* — Chip Law Group

(57) ABSTRACT

A sound output device includes a speaker that outputs sound, a housing that includes a sound introduction hook, the sound introduction hook having an internal space that is formed as a sound introduction space for introducing sound output from the speaker, the speaker being arranged in the housing, and an ear pad portion that is provided to be continuous to the housing, the sound introduction hook including an opening through which sound is emitted toward an ear, the sound introduction hook being to be mounted on a root portion of an auricle from a helix side, the ear pad portion being to be mounted on the root portion of the auricle from an earlobe side.

14 Claims, 14 Drawing Sheets

(52) U.S. Cl.
CPC ..... *H04R 1/1058* (2013.01); *H04R 5/0335* (2013.01); *H04R 2420/07* (2013.01); *H04R 2460/09* (2013.01)

(58) Field of Classification Search
USPC ..... 381/327, 330, 381, 382
See application file for complete search history.

(56) References Cited

U.S. PATENT DOCUMENTS

| | | | | |
|---|---|---|---|---|
| 9,398,363 | B2 * | 7/2016 | Takeno | H04R 5/0335 |
| 2006/0132382 | A1 * | 6/2006 | Jannard | G02B 27/017 345/8 |
| 2009/0123000 | A1 | 5/2009 | Wright | |
| 2011/0170723 | A1 * | 7/2011 | Ryann | A44C 7/00 381/322 |
| 2012/0008814 | A1 | 1/2012 | Alwicker et al. | |
| 2014/0270317 | A1 * | 9/2014 | Burgett | H04R 1/1066 381/381 |
| 2016/0134957 | A1 * | 5/2016 | Jentz | H04R 1/105 381/380 |
| 2016/0134958 | A1 * | 5/2016 | Thompson | H04R 1/105 381/381 |
| 2017/0034611 | A1 * | 2/2017 | Maruyama | H04R 1/105 |
| 2017/0272850 | A1 * | 9/2017 | Mihara | H04R 5/033 |
| 2017/0311070 | A1 * | 10/2017 | Igarashi | H04R 1/1016 |
| 2018/0324511 | A1 * | 11/2018 | Asada | H04R 1/02 |

FOREIGN PATENT DOCUMENTS

| | | | | |
|---|---|---|---|---|
| EP | 2591612 | A1 | 5/2013 | |
| JP | 04-101600 | A | 4/1992 | |
| JP | 05-076200 | U | 10/1993 | |
| JP | 05-80098 | U | 10/1993 | |
| JP | 05-080098 | U | 10/1993 | |
| JP | 10-023599 | A | 1/1998 | |
| JP | 2001-120590 | A | 5/2001 | |
| JP | 2013-115800 | A | 6/2013 | |
| JP | 2013-534115 | A | 8/2013 | |
| JP | 2014-500690 | A | 1/2014 | |
| JP | 2014-041611 | A | 3/2014 | |
| JP | 2015-056837 | A | 3/2015 | |
| JP | 2015-207956 | A | 11/2015 | |
| KR | 10-0198003 | B1 | 6/1999 | |
| KR | 10-2013-0041196 | A | 4/2013 | |
| WO | 2012/006211 | A1 | 1/2012 | |
| WO | 2014/041611 | A1 | 3/2014 | |
| WO | 2015/037317 | A1 | 3/2015 | |
| WO | 2015/162999 | A1 | 10/2015 | |
| WO | WO-2016067754 | A1 * | 5/2016 | H04R 5/033 |

OTHER PUBLICATIONS

International Search Report and Written Opinion of PCT Application No. PCT/JP2016/088981, dated Mar. 28, 2017, 10 pages of ISRWO.

Office Action for JP Patent Application No. 2017-565435, dated Jun. 8, 2021, 03 pages of Office Action and 02 pages of English Translation.

* cited by examiner

SOUND OUTPUT DEVICE

CROSS REFERENCE TO RELATED APPLICATIONS

This application is a U.S. National Phase of International Patent Application No. PCT/JP2016/088981 filed on Dec. 27, 2016, which claims priority benefit of Japanese Patent Application No. JP 2016-017271 filed in the Japan Patent Office on Feb. 1, 2016. Each of the above-referenced applications is hereby incorporated herein by reference in its entirety.

TECHNICAL FIELD

The present technology relates to a technical field regarding a sound output device in which speakers are arranged and which is used by being mounted on ears.

CITATION LIST

Patent Literature

Patent Literature 1: Japanese Patent Application Laid-open No. 2004-208220

Patent Literature 2: Japanese Patent Application Laid-open No. 2014-96739

BACKGROUND ART

There is a sound output device that is mounted on a head to be used as headphones or earphones and outputs sound from speakers.

In recent years, the sound output device has been increasingly used not only in a room but also outside a room. In a case where the sound output device is used outside a room, it is desirable that a user can hear both sound output from the sound output device and external sound in consideration of not only safety of the user but also safety of pedestrians, drivers, and the like existing around the user.

Various sound output devices have been developed as such a type of a sound output device that allows sound output from the above-mentioned sound output device and external sound to be heard (see, for example, Patent Literature 1 and Patent Literature 2).

A sound output device disclosed in Patent Literature 1 is configured such that a vibration element is arranged in a housing as a driver for outputting sound, vibration generated in the vibration element is transmitted to an ear bone existing on the periphery of an external auditory meatus and is transmitted to a brain from the ear bone through a skull and the like, and thus sound is recognized.

A through hole penetrating the housing and a vibrator is formed in this sound output device, and external sound is transmitted to a user through the through hole without blocking vibration of the vibrator.

In a sound output device disclosed in Patent Literature 2, a housing is formed by an insertion unit and a transmission member, an electroacoustic transducer element and a vibration body are arranged in the transmission member as a driver for outputting sound, and a plug movable inside and outside the insertion unit is provided. In the insertion unit, a through hole that allows hearing of external sound is provided.

This sound output device is mounted on an ear in a state in which a part of the insertion unit is inserted into an external auditory meatus and the transmission member is in contact with a tragus and an antitragus in front of the insertion unit. Sound is recognized in such a manner that vibration generated in the electroacoustic transducer element is transmitted from the vibration body to the transmission member and the transmitted vibration is transmitted from an ear bone to a brain through a skull and the like. External sound is vibrated into a space between the plug and an eardrum and transmitted to a user, and external sound can be differently heard by moving the plug at this time.

DISCLOSURE OF INVENTION

Technical Problem

By the way, the sound output device disclosed in Patent Literature 1 is formed into a shaft shape and used in a state in which the sound output device is inserted into an external auditory meatus. Thus, there is a possibility of falling off from the ear if the motion of a user is large.

Meanwhile, the sound output device disclosed in Patent Literature 2 includes a portion that is formed into a shaft shape and is to be inserted into an external auditory meatus, and a hook member that is formed into a substantially semicircular arc shape and is to be mounted on a root portion of an auricle. With the hook member, stability of the mounted state is enhanced as compared to the sound output device disclosed in Patent Literature 1.

However, since the hook member is hooked from above on the root portion of the auricle, when an external force in the vertical direction is imparted by a motion of the user, the hook member is floated from the ear and the sound output device is shifted from an adequate mounting position. Thus, there arises a possibility that sufficient stability of the mounted state is not secured.

In view of this, it is an object of a sound output device of the present technology to solve the above problems and to secure a stable mounted state to an ear.

Solution to Problem

First, a sound output device according to the present technology includes: a speaker that outputs sound; a housing that includes a sound introduction hook, the sound introduction hook having an internal space that is formed as a sound introduction space for introducing sound output from the speaker, the speaker being arranged in the housing; and an ear pad portion that is provided to be continuous to the housing, the sound introduction hook including an opening through which sound is emitted toward an ear, the sound introduction hook being to be mounted on a root portion of an auricle from a helix side, the ear pad portion being to be mounted on the root portion of the auricle from an earlobe side.

Accordingly, the sound introduction hook is to be mounted on the root portion of the auricle from the helix side, the ear pad portion is also to be mounted on the root portion of the auricle from the earlobe side, and the sound introduction hook and the ear pad portion are to be mounted on the ear from substantially the opposite sides.

Second, in the sound output device described above, it is desirable that the opening is to be positioned in an internal space of the auricle.

Accordingly, the opening is positioned close to an external auditory meatus.

Third, in the sound output device described above, it is desirable that the opening is to be positioned at a cavum conchae.

Accordingly, the opening is positioned close to the external auditory meatus.

Fourth, in the sound output device described above, it is desirable that the opening is formed on a side of the sound introduction hook, the side being to be faced to an external auditory meatus.

Accordingly, sound introduced through the sound introduction hook is emitted from the opening toward the external auditory meatus.

Fifth, in the sound output device described above, it is desirable that a portion of the sound introduction hook that includes the opening is provided as a detachable portion that is detachable from another portion of the sound introduction hook.

Accordingly, the portion of the sound introduction hook that includes the opening can be replaced depending on the size, the shape, or the like of the ear.

Sixth, in the sound output device described above, it is desirable that the sound introduction hook and the ear pad portion are formed into a continuous arc shape having substantially the same curvature.

Accordingly, the sound introduction hook and the ear pad portion are formed into a shape that substantially coincides with the shape of the root portion of the auricle.

Seventh, in the sound output device described above, it is desirable that the ear pad portion is formed of a material having a lower hardness than a hardness of the sound introduction hook.

Accordingly, the sound introduction hook to be mounted on the root portion of the auricle from the helix side has a higher hardness, and the ear pad portion to be mounted on the root portion of the auricle from the earlobe side has a lower hardness.

Eighth, in the sound output device described above, it is desirable that the ear pad portion is elastically deformable with respect to the sound introduction hook.

Accordingly, the sound introduction hook and the ear pad portion can be mounted on the ear in a state in which the ear pad portion is elastically deformed with respect to the sound introduction hook and thus a clearance therebetween is made large.

Ninth, in the sound output device described above, it is desirable that the portion of the sound introduction hook that includes the opening is not in contact with an ear in a state in which the sound introduction hook is mounted on the ear.

Accordingly, the portion including the opening that emits sound is not in contact with the ear.

Tenth, in the sound output device described above, it is desirable that a case body is arranged in the housing and that the speaker and a control board that controls the speaker are arranged in the case body.

Accordingly, the speaker and the control board are protected by the case body.

Eleventh, in the sound output device described above, it is desirable that a pair of housings and a pair of sound introduction hooks are provided and that the speaker is arranged in each of the housings as a pair.

Accordingly, the sound output device functions as a stereotype, and a balance favorable in terms of weight is secured between the pair of housings.

Twelfth, in the sound output device described above, it is desirable that a control board is arranged in one of the housings, and a battery is arranged in the other one of the housings.

Accordingly, a difference in weight between portions on both sides of the sound output device, the portions being to be mounted on ears, is reduced, and a balance favorable in terms of weight is secured.

Thirteenth, in the sound output device described above, it is desirable to provide a band that couples the pair of housings to each other.

Accordingly, transmission of sound signals and supply of a current to both the speakers can be performed by the band.

Fourteenth, in the sound output device described above, it is desirable that the band is formed into a belt-like shape.

Accordingly, the band is difficult to droop by gravity behind the head and to come into contact with a neck of the user.

Fifteenth, in the sound output device described above, it is desirable that the single housing and the single sound introduction hook are provided and that a battery is arranged in the housing.

Accordingly, it is possible to mount the sound introduction hook on one ear for use.

Sixteenth, in the sound output device described above, it is desirable that a part of the housing is positioned in contact with a temporal region behind the auricle.

Accordingly, the sound output device is mounted on the ears in a state in which the sound introduction hook is mounted on the root portion of the auricle and a part of the housing is in contact with the temporal region.

Seventeenth, in the sound output device described above, it is desirable that the sound introduction hook is bendable.

Accordingly, the sound introduction hook can be deformed depending on the shape or the size of the ear when the sound introduction hook is mounted on the ear.

Advantageous Effects of Invention

According to the present technology, since the sound introduction hook is to be mounted on the root portion of the auricle from the helix side, the ear pad portion is also to be mounted on the root portion of the auricle from the earlobe side, and the sound introduction hook and the ear pad portion are to be mounted on the ear from substantially the opposite sides, a stable mounted state to the ear can be secured.

Note that effects described in the present specification are merely examples and are not limited, and other effects may be exerted.

BRIEF DESCRIPTION OF DRAWINGS

FIG. 1 is a perspective view of an ear on which the sound output device is to be mounted.

MODE(S) FOR CARRYING OUT THE INVENTION

Hereinafter, a mode for implementing a sound output device of the present technology will be described with reference to the attached drawings.

In an embodiment to be described below, the sound output device of the present technology is applied to earphones. It should be noted that an application range of the present technology is not limited to the earphones but is widely applicable to various other sound output devices such as headphones.

<Structure of Ear>

Figure 1:
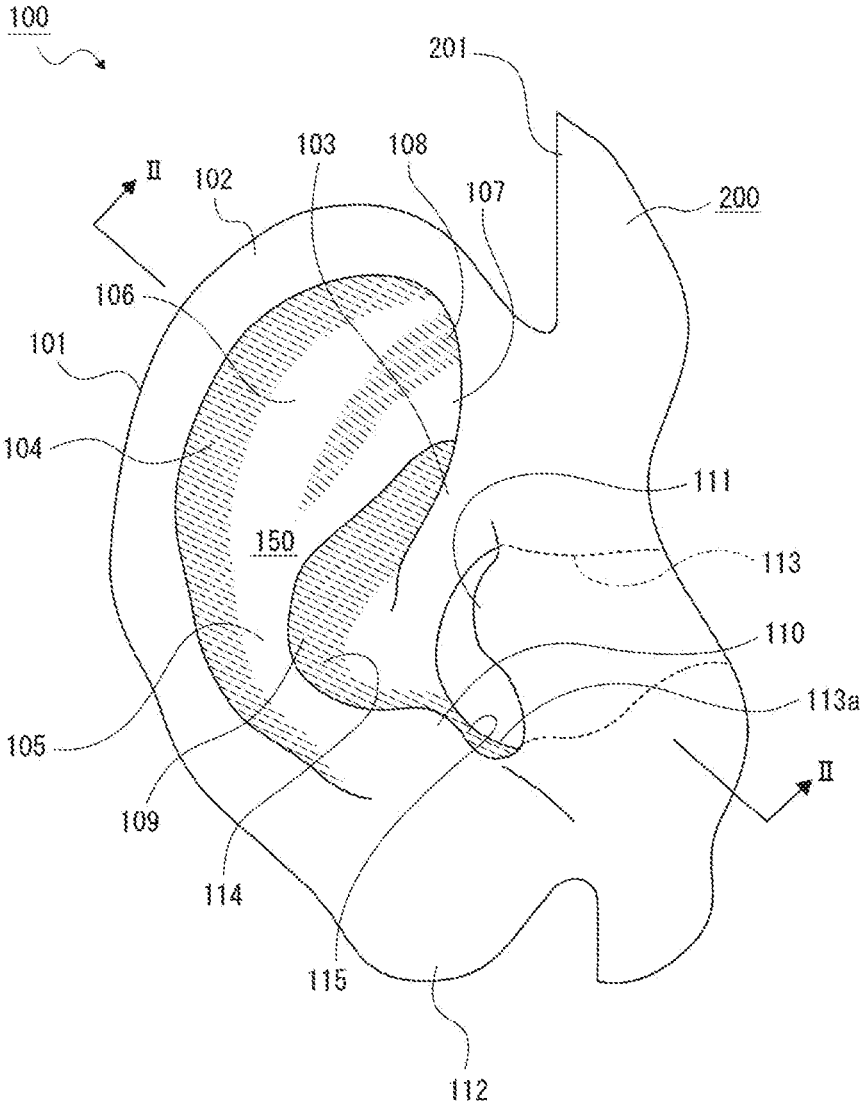
FIG. 1 illustrates, together with FIG. 2 to FIG. 15, an embodiment of a sound output device of the present technology.
Figure 2:
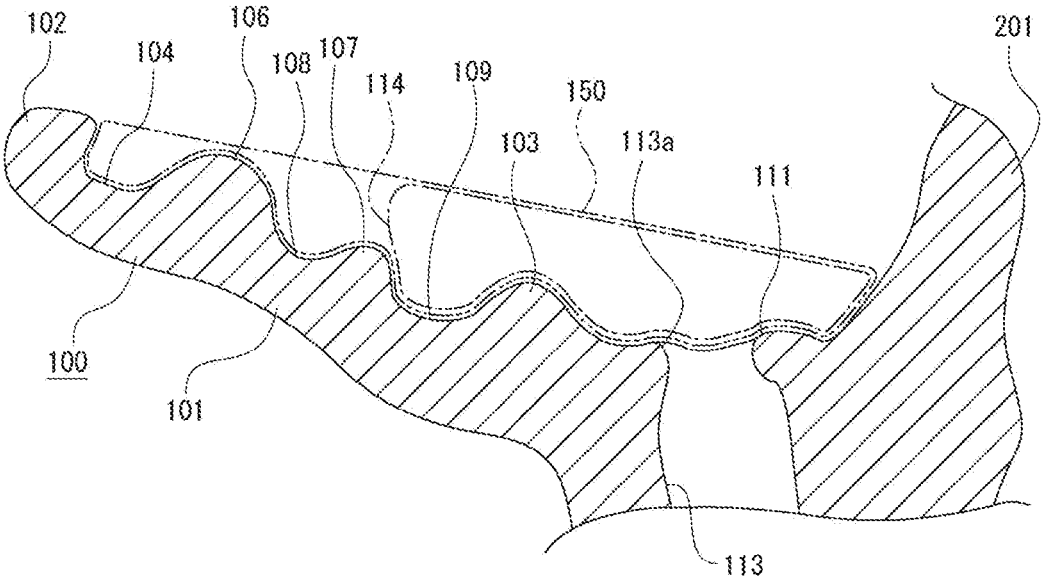
FIG. 2 is a cross-sectional view taken along the line II-II in FIG. 1.

A structure of an ear on which the sound output device is to be mounted will be described first (see FIG. 1 and FIG. 2).

Ears 100, 100 are part of a head 200 and include auricles 101, 101 and parts within the head 200, such as eardrums, semicircular canals, and *cochleae*. Portions of the head 200 on the inside of the auricles 101, 101 are temporal regions 201, 201, and the auricles 101, 101 are projected from the temporal regions 201, 201 to a left side and a right side.

The auricle 101 has a shallow recessed shape opened in a substantially forward direction as a whole so as to have an internal space 150, and an outer circumferential portion thereof includes a portion called "helix 102" and a portion called "crus of helix 103" continued to the helix 102 and positioned in the vicinity of the temporal region 201.

A portion on the inside of the helix 102 is called "scaphoid fossa 104" having a recessed shape, and a substantially lower half portion on the inside of the scaphoid fossa 104 is called "antihelix 105" having a projected shape. A portion continued to the antihelix 105 and having a bifurcated and projected shape exists above the antihelix 105, and a portion on the outside of the bifurcating portion and a portion on the inside of the bifurcating portion are called "superior crus of antihelix 106" and "inferior crus of antihelix 107", respectively. A portion between the superior crus of antihelix 106 and the inferior crus of antihelix 107 is called "triangular fossa 108" having a recessed shape, and a portion on the inside of the antihelix 105 and the inferior crus of antihelix 107 is called "cymba conchae 109" having a recessed shape.

A portion continued to a lower side of the antihelix 105 slightly bulges to the temporal region 201 side and is a portion called "antitragus 110". A portion on the temporal region 201 side, the portion facing the antitragus 110, is called "tragus 111" that slightly bulges to the antitragus 110 side, and a lower end portion continued to a lower side of the helix 102 is called "earlobe 112".

An external auditory meatus opening 113*a* serving as an entrance of an external auditory meatus 113 exists in a portion between the antitragus 110 and the tragus 111, and the external auditory meatus 113 communicates with the eardrum, the semicircular canals, and the like. A space surrounded by the antihelix 105, the inferior crus of antihelix 107, and the crus of helix 103 in the internal space 150 of the auricle 101, i.e., a space in front of the cymba conchae 109 is called "cavum conchae 114" and communicates with the external auditory meatus opening 113*a* of the external auditory meatus 113. A space that is continued to a lower side of the cavum conchae 114 in the internal space 150 and is opened to have a U shape is a space called "intertragic notch 115".

The internal space 150 of the auricle 101 is a space including a space near the cavum conchae 114, the intertragic notch 115, and the external auditory meatus opening 113*a* of the external auditory meatus 113 and also including a space in front of the scaphoid fossa 104, the antihelix 105, the superior crus of antihelix 106, the inferior crus of antihelix 107, the triangular fossa 108, the antitragus 110, and the tragus 111.

<Schematic Configuration of Sound Output Device>

Next, a configuration of the sound output device will be described (see FIG. 3 to FIG. 5).

A sound output device 1 includes housings 2, 2, ear pad portions 3, 3, and a band 4.

The housings 2, 2 are coupled to each other by the band 4. The housing 2 is formed of, for example, a rubber material such as silicon and includes an arrangement portion 5 continued to the band 4, a tubular portion 6 coupled to a portion of the arrangement portion 5 on the opposite side to the band 4, and a detachable portion 7 detachable from the tubular portion 6.

Case bodies 8, 8 are arranged inside the respective housings 2, 2. The case body 8 is arranged at a position crossing one end portion of the arrangement portion 5 and one end portion of the tubular portion 6 in the housing 2. The case body 8 includes a case portion 8*a* having a box shape opened on one side, and a lid portion 8*b* closing the case portion 8*a*. A sound output hole 8*c* is formed in the case body 8.

Speakers 9, 9 are arranged in the respective case bodies 8, 8. As the speaker 9, for example, a dynamic driver unit may be employed.

Note that, for example, various connection terminals such as a USB (Universal Serial Bus) terminal and a charging terminal, a sound output hole for a microphone, and the like may be formed in one or both of the housings 2, 2. In a case where a connection terminal is formed in the housing 2, a circuit corresponding to the connection terminal is arranged in the housing 2 in which the connection terminal is formed. Further, in a case where a sound output hole for a microphone is formed in the housing 2, a microphone is arranged in the housing 2 in which the sound output hole is formed.

The speaker 9 and a control board 10 are arranged in one housing 2, and a drive circuit for operating the speakers 9, 9 and a communication circuit for wireless communication are formed on the control board 10. Therefore, the sound output device 1 can receive sound signals from another device such as a music player via wireless communication, convert the received sound signals, and output the received sound signals from the speakers 9, 9 as sound and can perform pairing processing such as connection authentication with the music player. The wireless communication for receiving sound signals may correspond to, for example, short-range wireless communication such as Bluetooth (registered trademark), WiFi (wireless fidelity), and NFC (near field communication) serving as wireless communication for pairing processing such as connection authentication.

The control board 10 is arranged in the case body 8 together with the speaker 9.

In such a manner, in the sound output device 1, the speaker 9 and the control board 10 are arranged in the case body 8 arranged in the housing 2. Thus, the speaker 9 and the control board 10 are protected by the case body 8, and the speaker 9 and the control board 10 are prevented from being damaged, so that a favorable output state of the sound from the speaker 9 can be secured.

The speaker 9 and a battery 11 are arranged in the other housing 2. The battery 11 may be a disposable battery or rechargeable battery. In particular, in a case where the battery 11 is a disposable battery, it is desirable that a part of the housing 2 is openable/closable and the battery 11 can be replaced. Further, also in a case where the battery 11 is a rechargeable battery, a part of the housing 2 may be openable/closable and the battery 11 may be replaced.

The battery 11 is arranged in the case body 8 together with the speaker 9.

In such a manner, in the sound output device 1, the speaker 9 and the battery 11 are arranged in the case body 8 arranged in the housing 2. Thus, the speaker 9 and the battery 11 are protected by the case body 8, and the speaker 9 and the battery 11 are prevented from being damaged, so that a favorable output state of the sound from the speaker 9 can be secured.

Power of the battery 11 is supplied to the speakers 9, 9 and the control board 10 to operate the speakers 9, 9 and the control board 10. Supply of power from the battery 11 to the speaker 9 and the control board 10 arranged in the one housing 2 is performed via the band 4.

Therefore, an electrical wire for supplying power is provided in the band 4. Further, a signal wire for transmitting/receiving sound signals and other various signals is also provided in the band 4, and, for example, output of sound signals from the control board 10 arranged in the one housing 2 to the speaker 9 arranged in the other housing 2 is performed by the signal wire.

A switch board 12 is attached to an external surface of the case portion 8*a* of the case body 8 in which the control board 10 is arranged. A power supply switch 12*a* and volume control switches 12*b*, 12*b* are provided to the external surface of the switch board 12. The switch board 12 is connected to the control board 10. The power supply switch 12*a* is a switch for power-on and power-off of the power supply. One of the volume control switches 12*b*, 12*b* is a switch for turning up the volume, and the other one of the volume control switches 12*b*, 12*b* is a switch for turning down the volume.

An operation board 13 is arranged on the external surface side of the switch board 12. The operation board 13 includes three operation pieces 13*a*, 13*b*, 13*b*. The operation pieces 13*a*, 13*b*, 13*b* are positioned in contact with the power supply switch 12*a* and the volume control switches 12*b*, 12*b*, respectively.

The switch board 12 and the operation board 13 are arranged in the housing 2 together with the case body 8. The switch board 12 and the operation board 13 are set to be, for example, directed downward or obliquely downward in a state in which the sound output device 1 is mounted on the ear 100.

The tubular portion 6 includes a coupling portion 14 that is coupled to the arrangement portion 5 and has a diameter gradually reduced with increasing distance from the arrangement portion 5, and a bent portion 15 having a constant diameter.

A part of the case body 8 is arranged in the coupling portion 14, and the speaker 9 is arranged in the part of the case body 8 arranged in the coupling portion 14.

The bent portion 15 is formed into a substantially semicircular arc shape. The tip portion of the bent portion 15 is provided as an attachment portion 15*a*.

The detachable portion 7 is formed into a tubular shape having the same diameter as the bent portion 15 except one end portion, and the one end portion is opened and the other end portion (tip portion) is closed. The detachable portion 7 is formed into, for example, an arc shape having the same curvature as the bent portion 15.

The detachable portion 7 is formed of, for example, the same material as the tubular portion 6. It should be noted that the detachable portion 7 may be formed of a material having a lower hardness than a hardness of the tubular portion 6.

The one end portion of the detachable portion 7 is provided as an attached portion 7*a* whose diameter is slightly smaller than a diameter of the bent portion 15. For example, two openings 7*b*, 7*b* are formed at positions close to the other end of the detachable portion 7. The openings 7*b*, 7*b* are penetrated in a direction orthogonal to the longitudinal direction of the detachable portion 7. The openings 7*b*, 7*b* are formed at a portion of the detachable portion 7 on the side that is to be faced to the external auditory meatus 113 in a state in which the sound output device 1 is mounted on the ear 100.

Note that the number of openings 7*b* is arbitrary, and one opening may be formed, or three or more openings may be formed.

The detachable portion 7 is attached to the bent portion 15 in such a manner that the attached portion 7*a* is fitted into the attachment portion 15*a*. Further, the detachable portion 7 can be removed from the bent portion 15 when the detachable portion 7 is pulled out from the bent portion 15.

Figure 6:
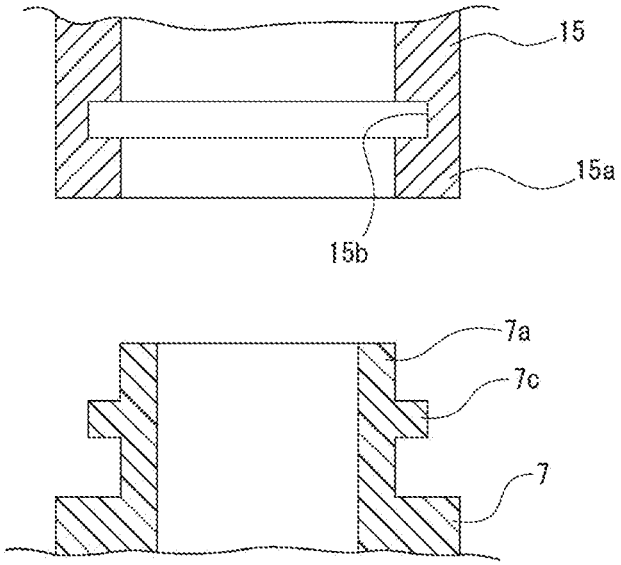
FIG. 6 is an enlarged cross-sectional view illustrating another example of an attachment portion of a bent portion and an attached portion of a detachable portion.

Note that the example in which the attached portion 7*a* is fitted into the attachment portion 15*a* and the detachable portion 7 is thus attached to the bent portion 15 has been described above, but the following configuration can also be provided: one of the detachable portion 7 and the bent portion 15 is provided with a protruding portion, and the other one is provided with a recessed portion, so that the detachable portion 7 is attached to the bent portion 15 (see FIG. 6). For example, an engaging protruding portion 7*c* having an annular shape is provided at a position of the detachable portion 7, which is close to one end thereof, and an engaging recessed portion 15*b* having an annular shape is formed at a position of the bent portion 15, which is close to the tip thereof. The engaging protruding portion 7*c* and the engaging recessed portion 15*b* are engaged with each other, and the detachable portion 7 is attached to the bent portion 15.

As described above, the detachable portion 7 is detachable from the bent portion 15. For the detachable portion 7, various types different in shape or size are used. For example, a type different in length, a type different in curvature, or the like is used for the detachable portion 7. By use of such a detachable portion 7 having a different length or curvature, the detachable portion 7 having a different length or curvature can be attached to the bent portion 15 depending on the size or the shape of the ear 100, and the openings 7*b*, 7*b* can be positioned at desired positions.

Further, for example, a type that has the thickness increasing toward the tip or a type that has the thickness decreasing toward the tip may be used for the detachable portion 7. By use of the detachable portion 7 of a type that has the thickness increasing toward the tip, sound output from the speaker 9 can be easily heard. Meanwhile, by use of the detachable portion 7 of a type that has the thickness decreasing toward the tip, external sound can be easily heard, and sound leakage of sound output from the speaker 9 can be suppressed.

Furthermore, for example, a type that is inclined in a direction approaching the external auditory meatus 113 can also be used for the detachable portion 7. By use of the detachable portion 7 of such a type, sound leakage of sound output from the speaker 9 can be suppressed, and sound can be easily heard.

The bent portion 15 and detachable portion 7 described above are configured as a sound introduction hook 16 that introduces the sound output from the speaker 9 to the inner space thereof. Therefore, the inner space in the sound introduction hook 16 is formed as a sound introduction space 16*a* that introduces the sound output from the speaker 9. The sound introduced to the sound introduction space 16*a* is emitted toward the outside from the openings 7*b*, 7*b* formed in the detachable portion 7.

Note that the detachable portion 7 may be formed of a material (flexible material) that is deformable (bendable) and holds a deformed state. The detachable portion 7 is formed of such a material, and thus the detachable portion 7 can be deformed in a desired state, which enables, for example, the openings 7*b*, 7*b* to be moved close to the external auditory meatus 113 or the orientation of the sound emitted from the openings 7*b*, 7*b* to be changed as necessary, in the state in which the sound output device 1 is mounted on the ear 100.

As described above, in the sound output device 1, the portion of the sound introduction hook 16 that includes the openings 7*b*, 7*b* is provided as the detachable portion 7 that is detachable from the other portion of the sound introduction hook 16. Therefore, the portion of the sound introduction hook 16 that includes the openings 7*b*, 7*b* can be replaced depending on the size, the shape, or the like of the ear 100, and a favorable hearing state of sound can be secured irrespective of the size, the shape, or the like of the ear 100.

Further, as described above, the tubular portion 6 and the detachable portion 7 are formed of a rubber material, and the sound introduction hook 16 is configured by a rubber material. The sound introduction hook 16 is a portion to be mounted on the root portion of the auricle 101 of a user. The sound introduction hook 16 is formed of a rubber material, and thus the sound introduction hook 16 is to be mounted on the ear 100 in a fitted state, and a favorable wearing feeling of the sound output device 1 can be secured.

Note that the sound introduction hook 16 may be formed of a resin material or may be configured by a multi-layer structure. For example, the sound introduction hook 16 may have a double-layer structure including an inner circumferential side portion and an outer circumferential side portion, and may be configured by an inner layer of a metal material and an outer layer of a rubber material or resin material. Using a metal material for the sound introduction hook 16 enables the rigidity of the sound introduction hook 16 to be enhanced. In particular, using aluminum or the like as a metal material can secure a favorable wearing feeling of the sound output device 1 by reduction in weight of the sound introduction hook 16.

Note that the example in which the detachable portion 7 is formed of a material that is deformable (bendable) and holds a deformed state has been described above, but both of the tubular portion 6 and the detachable portion 7 may be formed of a material that is deformable (bendable) and holds a deformed state. The tubular portion 6 and the detachable portion 7 are formed of such a material, and thus the sound introduction hook 16 can be deformed in a desired state, which enables, for example, the openings 7*b*, 7*b* to be moved close to the external auditory meatus 113 or the orientation of the sound emitted from the openings 7*b*, 7*b* to be changed as necessary, in the state in which the sound output device 1 is mounted on the ear 100.

Further, since the sound introduction hook 16 can be deformed depending on the shape or the size of the ear 100 when the sound introduction hook 16 is mounted on the ear 100, a stable mounted state of the sound output device 1 to the ear 100 can be secured.

Figure 3:
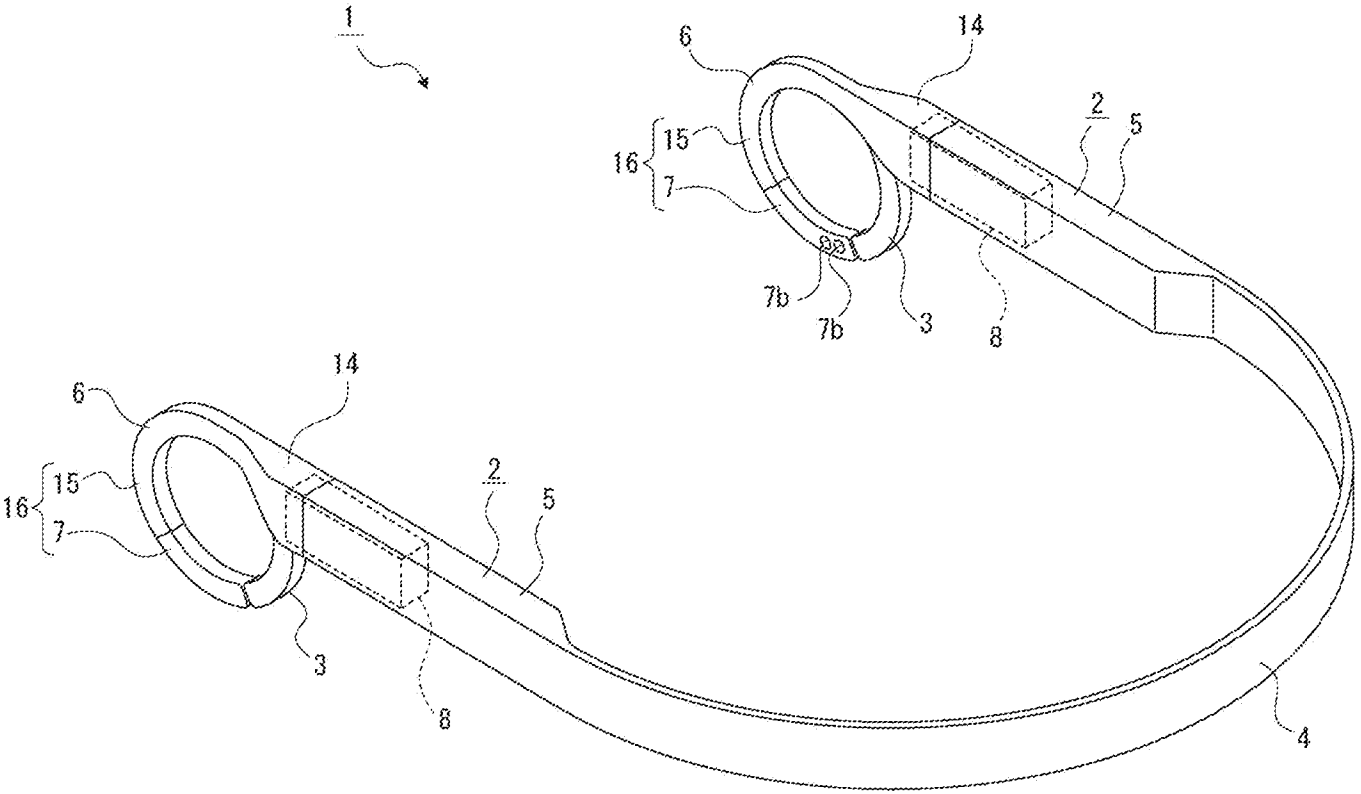
FIG. 3 is a perspective view of the sound output device.
Figure 4:
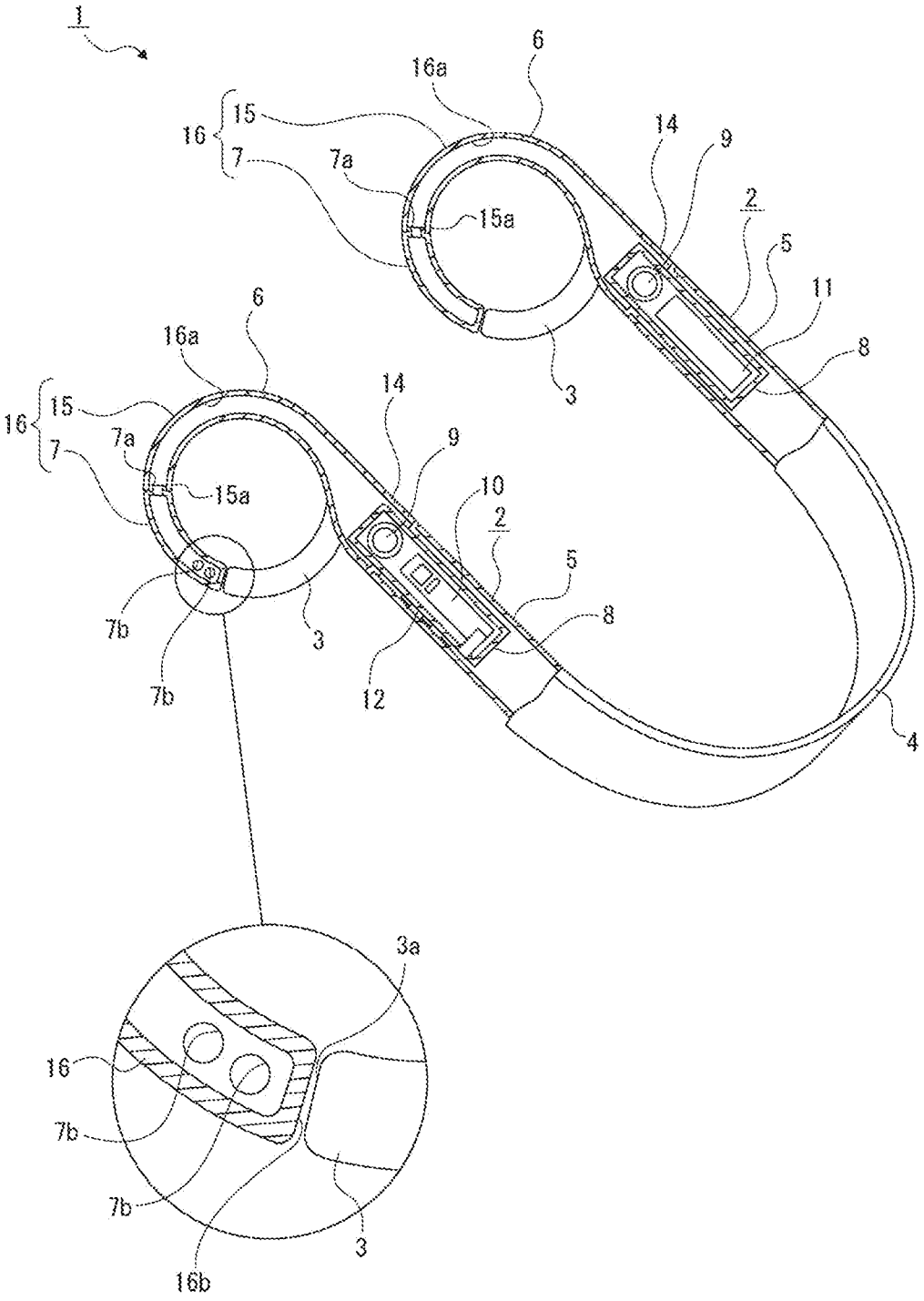
FIG. 4 is a perspective view of the sound output device a part of which is illustrated as a cross-sectional view.
Figure 5:
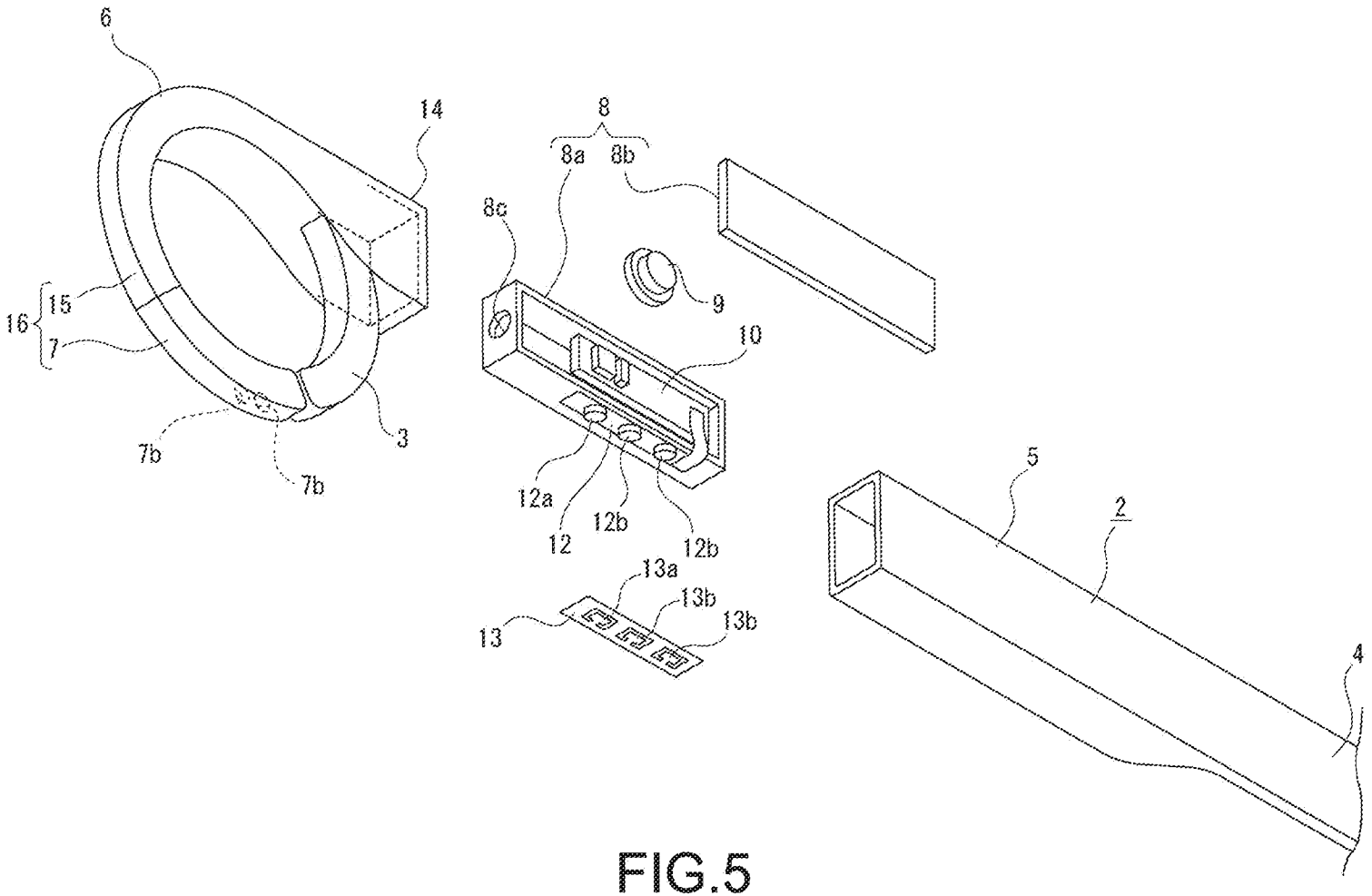
FIG. 5 is an exploded perspective view of a structure or the like arranged in a housing.

The ear pad portion 3 is projected from a boundary portion between the arrangement portion 5 and the tubular portion 6 (see FIG. 3 to FIG. 5).

Figure 7:
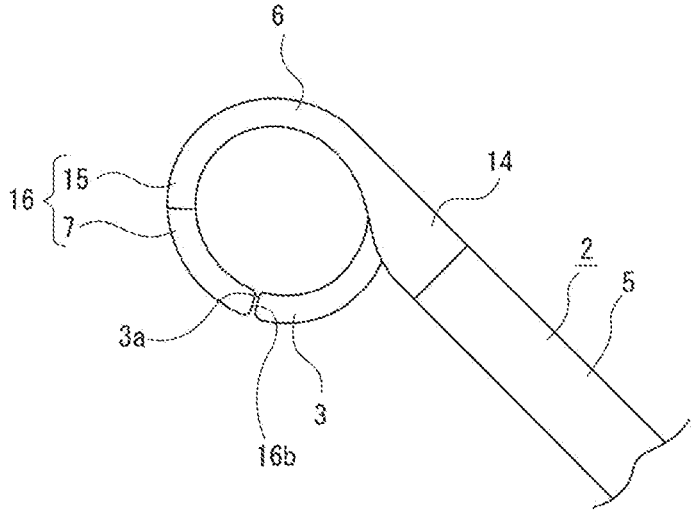
FIG. 7 is a side view of a part of the sound output device in a state in which an ear pad portion is not elastically deformed.

The ear pad portion 3 is formed of a material having a lower hardness than a hardness of the housing 2, for example, a rubber material, and is elastically deformable with respect to the tubular portion 6. When the ear pad portion 3 is not elastically deformed, the ear pad portion 3 has an arc shape having the same curvature as the sound introduction hook 16, and a tip surface 3*a* is positioned in a state facing a tip surface 16*b* of the sound introduction hook 16 (see the enlarged view of FIG. 4 and FIG. 7).

The ear pad portion 3 is, for example, integrally formed with the tubular portion 6. The ear pad portion 3 is integrally formed with the tubular portion 6, and thus it is possible to reduce the manufacturing cost of the sound output device 1 due to reduction in number of components. Further, the ear pad portion 3 is integrally formed with the tubular portion 6, and thus it is unnecessary to perform an operation of combining the ear pad portion 3 with the tubular portion 6, and it is also possible to reduce the manufacturing cost of the sound output device 1 due to reduction in number of manufacturing processes.

Figure 8:
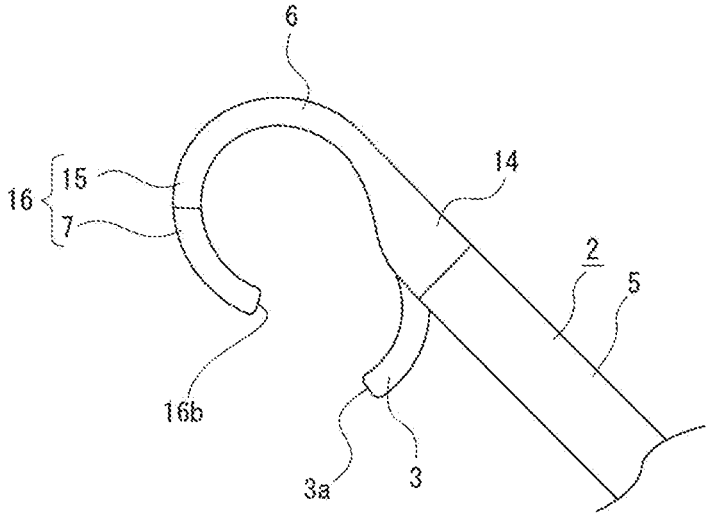
FIG. 8 is a side view of a part of the sound output device in a state in which the ear pad portion is elastically deformed.

The ear pad portion 3 is elastically deformed with respect to the housing 2, and thus the tip surface 3*a* can be separated from the tip surface 16*b* of the sound introduction hook 16, and a large clearance can be formed between the tip surface 3*a* and the tip surface 16*b* (see FIG. 8).

Both end portions of the band 4 are continued to the arrangement portions 5, 5 of the housings 2, 2 (see FIG. 3 and FIG. 4). The band 4 is formed of, for example, a rubber material and into a belt-like shape whose vertical direction is orientated in the width direction.

The band 4 is, for example, integrally formed with the arrangement portions 5, 5. The band 4 is integrally formed with the arrangement portions 5, 5, and thus it is possible to reduce the manufacturing cost of the sound output device 1 due to reduction in number of components. Further, the band 4 is integrally formed with the arrangement portions 5, 5, and thus it is unnecessary to perform an operation of combining the band 4 with the arrangement portions 5, 5, and it is also possible to reduce the manufacturing cost of the sound output device 1 due to reduction in number of manufacturing processes.

As described above, the sound output device 1 includes the pair of housings 2, 2 and the pair of ear pad portions 3, 3, and the speakers 9, 9 are arranged in the housings 2, 2, respectively.

Therefore, the sound output device 1 functions as a stereotype and functionality of the sound output device 1 is improved, and thus it is possible to hear high quality sound. Further, since the speakers 9, 9 are arranged in the housings 2, 2, a balance favorable in terms of weight with respect to the ears 100, 100 is secured, and thus it is possible to stably mount the sound output device 1 on the ears 100, 100.

Further, in the sound output device 1, the control board 10 is arranged in the one housing 2, and the battery 11 is arranged in the other housing 2. Therefore, a difference in weight between portions on both sides of the sound output device 1, the portions being to be mounted on the ears 100, 100, is reduced and a balance favorable in terms of weight is secured, and thus it is possible to stably mount the sound output device 1 on the ear 100.

Furthermore, since the housings 2, 2 are coupled to each other by the band 4, transmission of sound signals and supply of a current to both the speakers 9, 9 can be performed by the band 4, and favorable functionality of the sound output device 1 can be secured.

Further, since the housings 2, 2 are coupled to each other by the band 4, the positions of the housings 2, 2 coupled to each other by the band 4 with respect to the ears 100, 100 become stable, and the sound output device 1 can be stably mounted on the ears 100, 100.

<Mounted State of Sound Output Device to Ear>

Hereinafter, a mounted state of the sound output device 1 to the ears 100, 100 will be described (see FIG. 9 to FIG. 13).

The sound introduction hooks 16, 16 of the sound output device 1 are mounted on the root portions of the auricles 101, 101 of the head 200, i.e., on boundary portions between the auricles 101, 101 and the temporal regions 201, 201 or portions therearound, from the side of the helixes 102 and 102 (upper side).

Further, the ear pad portions 3, 3 are mounted on the root portions of the auricles 101, 101, i.e., on boundary portions between the auricles 101, 101 and the temporal regions 201, 201 or portions therearound, from the side of the earlobes 112.

At that time, since the ear pad portions 3, 3 are elastically deformable with respect to the sound introduction hooks 16, 16, the sound introduction hooks 16, 16 and the ear pad portions 3, 3 can be mounted on the ears 100, 100 in a state in which the ear pad portions 3, 3 are elastically deformed with respect to the sound introduction hooks 16, 16. Thus, the clearance between the tip surface 3*a* and the tip surface 16*b* is made large, so that the mounting of the sound output device 1 on the ears 100, 100 can be easily performed.

Further, the sound output device 1 is mounted on the ears 100, 100 in a state in which the ear pad portions 3, 3 are elastically deformed and the clearance between the tip surface 3*a* and the tip surface 16*b* is made larger than a clearance before the sound output device 1 is mounted on the ears 100, 100.

Therefore, since a force in a direction in which the sound introduction hook 16 and the ear pad portion 3 approaches each other is imparted to the sound introduction hook 16 and the ear pad portion 3, the sound output device 1 can be mounted on the ear 100 in a state in which the sound introduction hook 16 and the ear pad portion 3 are pushed against the root portion of each auricle 101, so that the sound output device 1 can be stably mounted on the ear 100.

Figure 11:
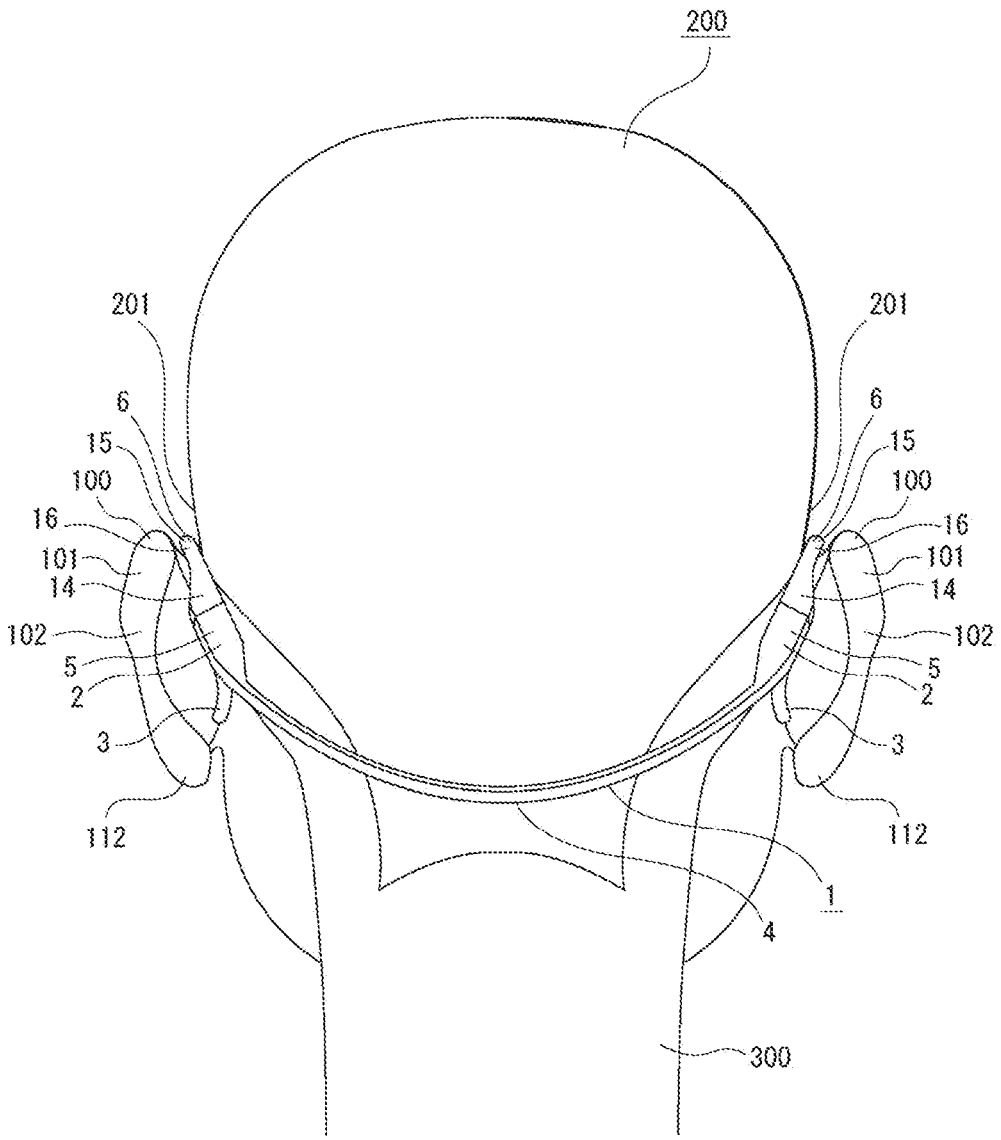
FIG. 11 is a rear view illustrating a state in which the sound output device is mounted on the ears.

In the state in which the sound introduction hooks 16, 16 and the ear pad portions 3, 3 are mounted on the root portions of the auricles 101, 101 as described above, the arrangement portions 5, 5 are pushed against the rear portions of the auricles 101, 101 of the temporal regions 201, 201 (see FIG. 11).

Figure 12:
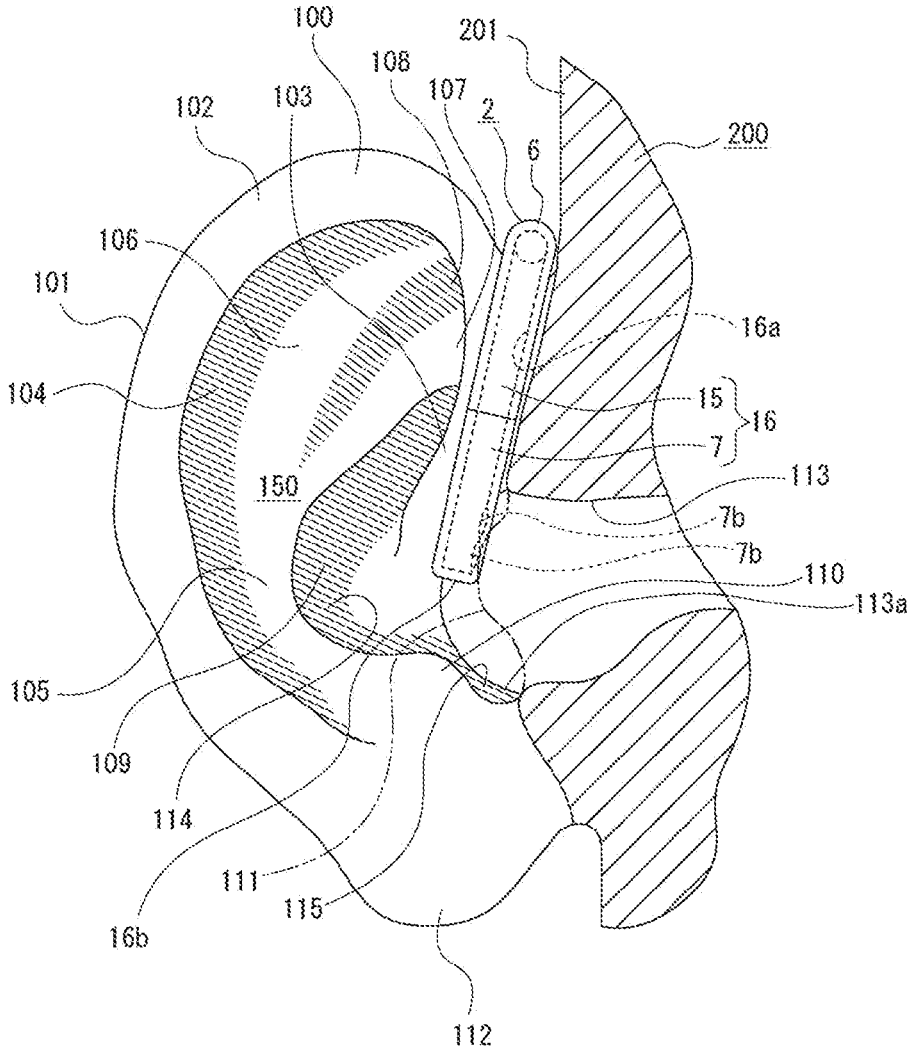
FIG. 12 is a front view illustrating a state in which the sound output device is mounted on an ear and an opening of a sound introduction hook is positioned near an external auditory meatus opening, a part of which is illustrated as a cross-sectional view.

At that time, at least parts of the detachable portions 7, 7 are positioned in the internal spaces 150, 150 of the auricles 101, 101 in a state in which the tip portions of the detachable portions 7, 7 are not in contact with the auricles 101, 101 (see FIG. 12). The detachable portions 7, 7 are positioned so as not to block the whole of the external auditory meatus openings 113*a*, 113*a*, the openings 7*b*, 7*b* are positioned near the external auditory meatus openings 113*a*, 113*a* of the external auditory meatuses 113, 113, and the portions of the sound introduction hooks 16 that include the openings 7*b*, 7*b* are not in contact with the ears 100.

In such a manner, since the portion of the sound introduction hook 16 that includes the openings 7*b*, 7*b* is not in contact with the ear 100 in the state in which the sound output device 1 is mounted on the ear 100, the portion including the openings 7*b*, 7*b* from which sound is emitted is not in contact with the ear 100. Thus, it is possible to secure favorable recognizability of sound output from the sound output device 1 and external sound and also reduce the occurrence of discomfort in the mounted state to the ear 100.

Further, since the openings 7*b*, 7*b* are formed on the side of the sound introduction hook 16, the side being to be faced to the external auditory meatus 113, sound introduced through the sound introduction hook 16 is emitted from the openings 7*b*, 7*b* toward the external auditory meatus 113, and the sound can be favorably heard.

Figure 13:
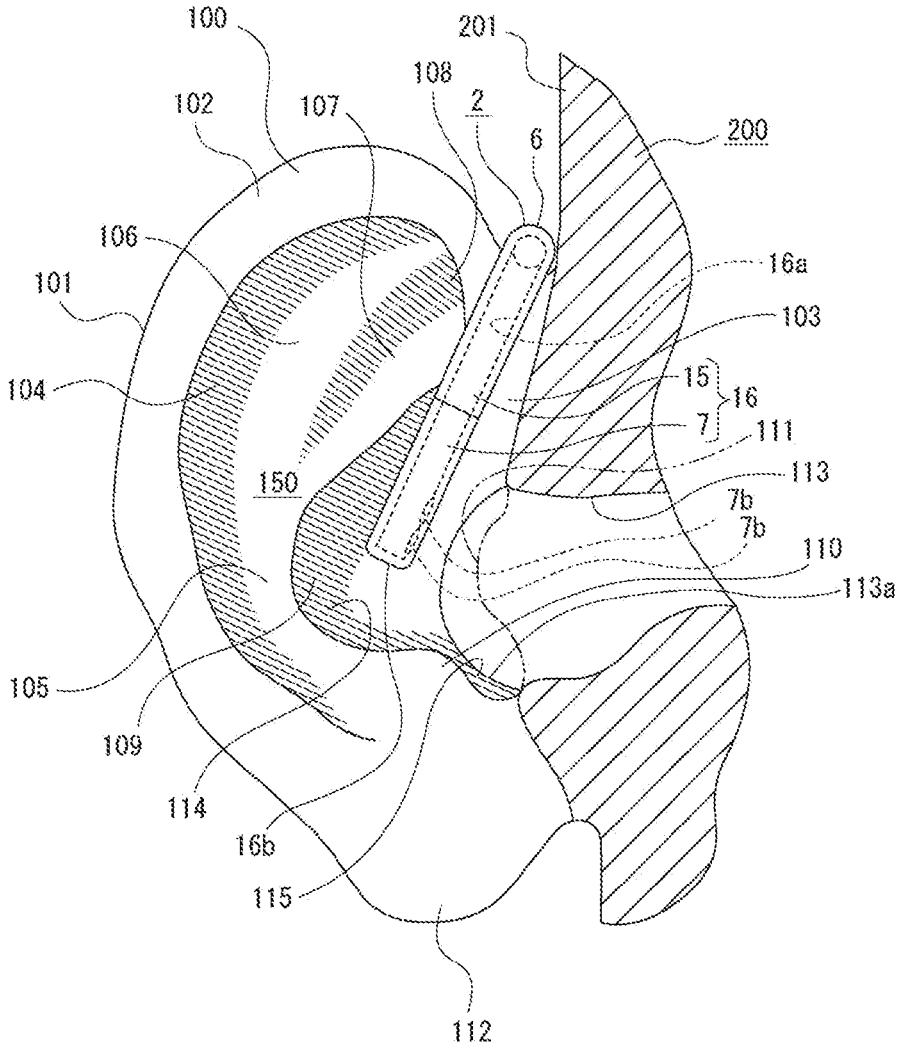
FIG. 13 is a front view illustrating a state in which the sound output device is mounted on an ear and the opening of the sound introduction hook is positioned at a cavum conchae, a part of which is illustrated as a cross-sectional view.

Note that, in a state in which the sound output device 1 is mounted on the ears 100, 100, the openings 7*b*, 7*b* of the detachable portions 7, 7 in the sound introduction hooks 16, 16 may be positioned at the cavum conchae 114, 114 (see FIG. 13).

Further, the openings 7*b*, 7*b* of the detachable portions 7, 7 do not need to be positioned at the external auditory meatuses 113, 113 or the cavum conchae 114, 114, and may be positioned apart from the external auditory meatuses 113, 113 and the cavum conchae 114, 114 as long as the openings 7*b*, 7*b* are positioned in the internal spaces 150, 150 of the auricles 101, 101.

Note that the openings 7*b*, 7*b* of the detachable portions 7, 7 may be positioned outside the internal spaces 150, 150 of the auricles 101, 101 depending on the shape or the size of the ears 100 of the user.

Figure 9:
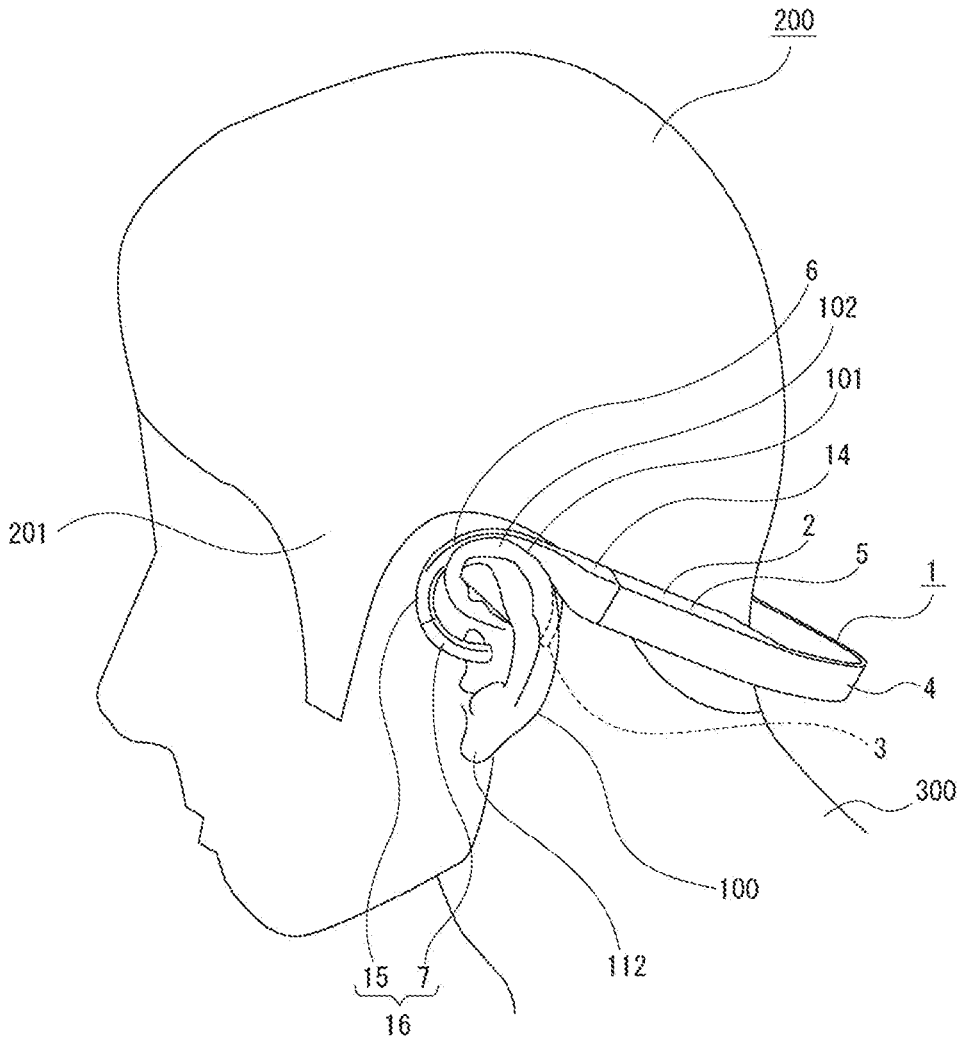
FIG. 9 is a perspective view illustrating a state in which the sound output device is mounted on ears.
Figure 10:
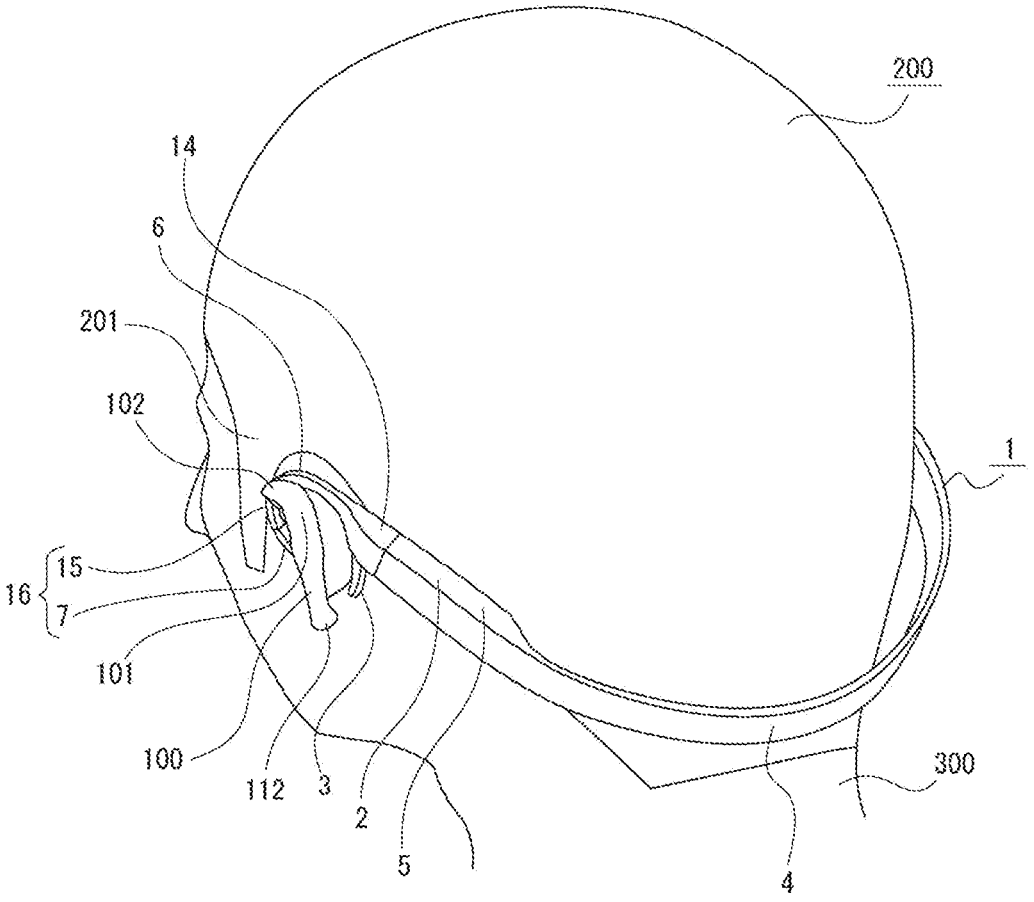
FIG. 10 is a perspective view illustrating a state in which the sound output device is mounted on the ears, when viewed from an angle different from FIG. 10.

As described above, in a state in which the sound output device 1 is mounted on the ears 100, 100, the arrangement portions 5, 5 are positioned in contact with the head 200 behind the auricles 101, 101 (see FIG. 9 to FIG. 11).

Therefore, the sound output device 1 is mounted on the ears 100, 100 in a state in which the sound introduction hooks 16, 16 are mounted on the root portions of the auricles 101, 101 and the arrangement portions 5, 5 are in contact with the head 200, and thus the sound output device 1 can be stably mounted on the ears 100, 100.

Further, since the structures such as the case bodies 8 arranged in the arrangement portions 5, 5 and the housings 2, 2 do not exist in front of the auricles 101, 101, the size of the structures existing in front of the auricles 101, 101 is reduced, and an influence upon the head-related transfer function is suppressed. Thus, it is possible to restrain reduction in space perception ability.

Furthermore, since the openings 7*b*, 7*b* of the detachable portions 7, 7 are positioned in the vicinity of the external auditory meatuses 113, 113 or near the external auditory meatus openings 113*a*, 113*a* of the external auditory meatuses 113, 113, positions at which sound is emitted exist in the vicinity of the external auditory meatuses 113, 113, and therefore it is possible to favorably hear sound.

In a state in which the sound output device 1 is mounted on the ears 100, 100, the band 4 is positioned behind the head 200. At that time, the band 4 is formed into a belt-like shape whose vertical direction is orientated in the width direction, and thus the band 4 is difficult to droop by gravity behind the head 200 and to come into contact with a neck 300 of the user (see FIG. 9).

Therefore, the band 4 is easily prevented from coming into contact with the neck 300 or the head 200, and a favorable mounted state of the sound output device 1 can be secured.

In the state in which the sound output device 1 is mounted on the ears 100, 100 as described above, the operation pieces 13*a*, 13*b*, 13*b* are operated by pressing from the external surface side of the housing 2, and thus the power supply switch 12*a* or the volume control switches 12*b*, 12*b* are operated to perform power-on or power-off of the power supply or change of the volume. When the power supply switch 12*a* is operated and the power supply is powered on, sound is emitted from the speakers 9, 9 through the sound output holes 8*c*, 8*c* formed in the case bodies 8, the sound introduction spaces 16*a*, 16*a* of the sound introduction hooks 16, 16, and the openings 7*b*, 7*b*, . . . toward the external auditory meatuses 113, 113.

<Another Example of Sound Output Device>

Figure 14:
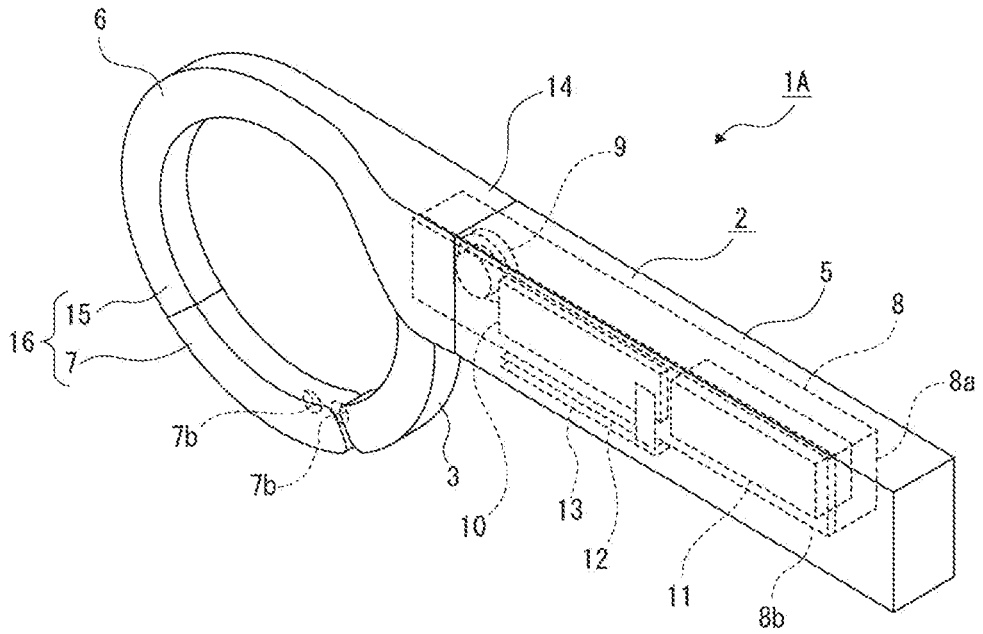
FIG. 14 is a perspective view of another example of the sound output device.

In the above description, an example of the sound output device 1 including the pair of housings 2, 2, the pair of ear pad portions 3, 3, and the band 4 has been described. However, for example, it is also possible to use a sound output device 1A including one housing 2 and one ear pad portion 3 as will be described below (see FIG. 14).

Note that the sound output device 1A to be described below is different from the sound output device 1 described above only in that the number of housings and the number of ear pad portions are different, that a band is not provided, and that an internal structure of the housing is different. Therefore, only differences between the sound output device 1A and the sound output device 1 will be described in detail, and the other portions will be denoted by the same reference signs as the reference signs denoting similar portions in the sound output device 1 and description thereof will be omitted.

The sound output device 1A includes one housing 2 and one ear pad portion 3.

The case body 8 is arranged in the housing 2, and the speaker 9, the control board 10, and the battery 11 are arranged in the case body 8. The switch board 12 is attached to the case body 8, and the operation board 13 is arranged on the external surface side of the switch board 12. Any of the control board 10 and the battery 11 may be arranged on the speaker 9 side. Power of the battery 11 is supplied to the speaker 9 and the control board 10 to drive the speaker 9 and the control board 10.

Note that, for example, various connection terminals such as a USB (universal serial bus) terminal and a charging terminal, a sound input hole for a microphone, and the like may be formed in the housing 2. In a case where a connection terminal is formed in the housing 2, a circuit corresponding to the connection terminal is arranged in the housing 2. In a case where a sound input hole for a microphone is formed in the housing 2, a microphone is arranged in the housing 2.

In the sound output device 1A, the sound introduction hook 16 is to be mounted on a root portion of the left or right auricle 101 of the head 200, i.e., a boundary portion between the auricle 101 and the temporal region 201 or a portion therearound from the helix 102 side (upper side), and the ear pad portion 3 is to be mounted on the root portion of the auricle 101, i.e., a boundary portion between the auricle 101 and the temporal region 201 or a portion therearound from the earlobe 112 side (lower side).

In the state in which the sound introduction hook 16 and the ear pad portion 3 are mounted on the root portion of the auricle 101, the arrangement portion 5 is pushed against the rear portion of the auricle 101 of the temporal region 201.

At that time, at least a part of the detachable portion 7 is positioned in the internal space 150 of the auricle 101 in a state in which the tip portion of the detachable portion 7 is not in contact with the auricle 101. The detachable portion 7 is positioned so as not to block the whole of the external auditory meatus opening 113*a*, the openings 7*b* are positioned near the external auditory meatus opening 113*a* of the external auditory meatus 113, and the portion of the sound introduction hook 16 that includes the openings 7*b*, 7*b* is not in contact with the ear 100.

The portion of the sound introduction hook 16 that includes the openings 7*b*, 7*b* is positioned at the cavum conchae 114 or the external auditory meatus 113 in the internal space 150 of the auricle 101.

It should be noted that the portion of the sound introduction hook 16 that includes the openings 7*b*, 7*b* does not need to be positioned at the cavum conchae 114 or the external auditory meatus 113, and may be positioned apart from the external auditory meatus 113 and the cavum conchae 114 as long as the portion including the openings 7*b*, 7*b* is positioned in the internal space 150.

Note that the portion of the sound introduction hook 16 that includes the openings 7*b*, 7*b* may be positioned outside the internal space 150 of the auricle 101 depending on the shape or the size of the ear 100 of the user.

As described above, the sound output device 1A includes one housing 2 and one ear pad portion 3, and the battery 10 is arranged in the housing 2.

Therefore, it is possible to mount the sound introduction hook 16 on one ear 100 to use the sound output device 1A, and thus it is possible to easily mount the sound output device 1A on the ear 100 and improve usability.

Further, since the sound output device 1A is mounted only on one ear 100, it is possible to reduce a load applied to the user when the sound output device 1A is mounted on the ear 100 and to secure a favorable wearing feeling of the sound output device 1A.

Figure 15:
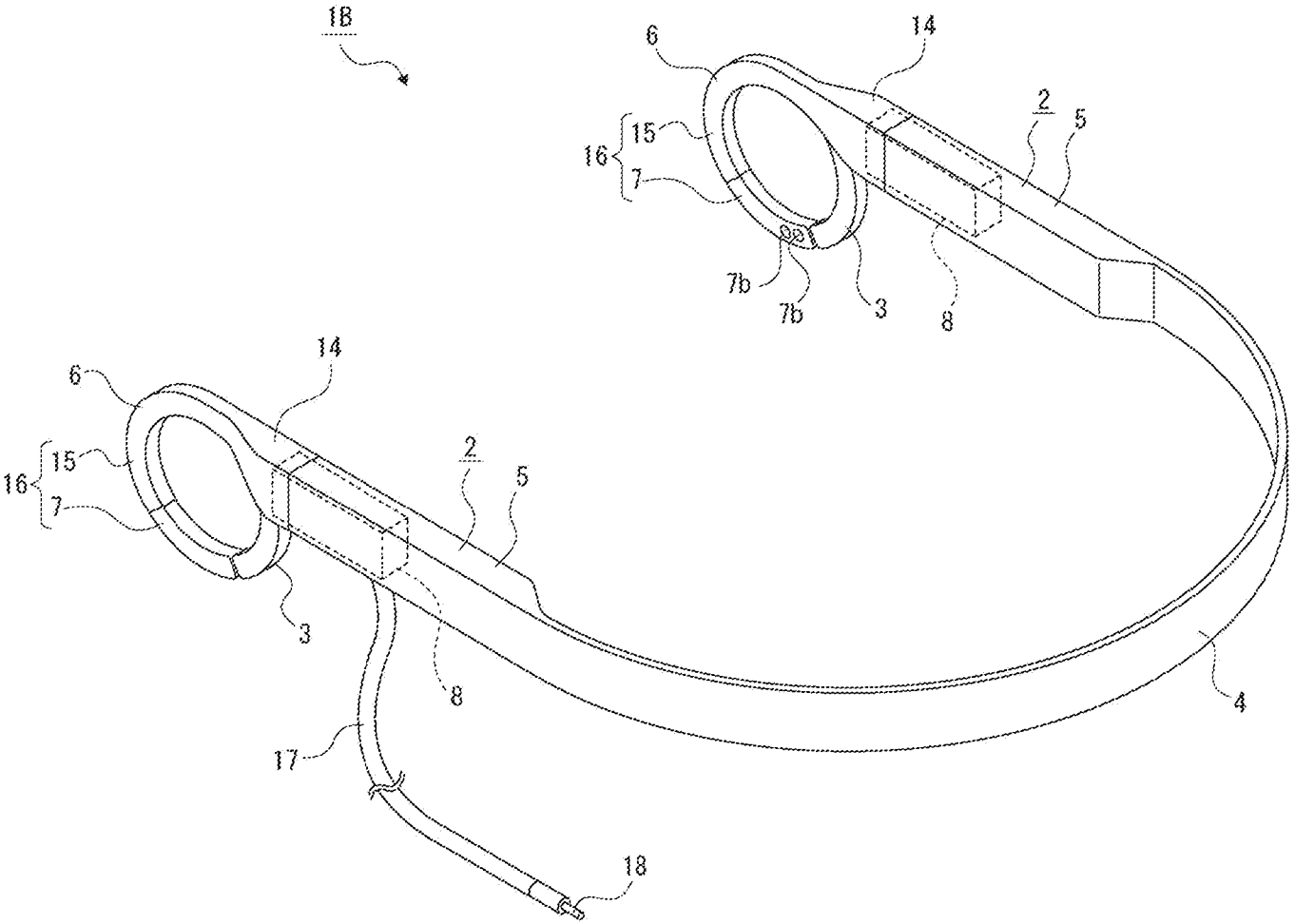
FIG. 15 is a perspective view of still another example of the sound output device.

In the above description, the examples of the sound output devices 1 and 1A that receive sound signals from another device such as a music player by wireless communication have been described. However, it is also possible to configure a sound output device 1B that inputs sound signals from another device such as a music player by wired connection as will be described below (see FIG. 15).

Note that the sound output device 1B may be of a type including two speakers 9, 9, such as the sound output device 1, or of a type including one speaker 9, such as the sound output device 1A. In the following description, a sound output device 1B of a type including two speakers 9, 9 will be taken as an example.

The sound output device 1B includes the housings 2, 2, the ear pad portions 3, 3, and the band 4, and for example, a cable 17 is coupled to one housing 2. One end portion of the cable 17 is connected to the speaker 9 and the switch board 12 individually. The other end portion of the cable 17 includes a connector 18, and the connector 18 is to be connected to an output terminal portion of another device such as a music player. The two speakers 9, 9 are connected to the pair of housings 2, 2 by electrical wires provided in the band 4.

Note that in the sound output device 1B, the cable 17 may be coupled to the band 4 or the ear pad portion 3 to be connected to the speaker 9 and the switch board 12 individually.

The speaker 9 is arranged in the case body 8, the switch board 12 is attached to the external surface of the case body 8, and the operation board 13 is arranged on the external surface side of the switch board 12.

The control board 10 and the battery 11 are not arranged in the housings 2, 2. The power supply to the sound output device 1B and the input of sound signals are performed by another device such as a music player via the cable 17.

In such a manner, in the sound output device 1B, sound signals are input by wired connection, and the control board 10 and the battery 11 are not arranged in the housings 2, 2. Thus, it is possible to reduce the weight and to simplify the internal structure.

Further, since the reduction in weight is achieved in the sound output device 1B as described above, an excessive load is not applied to the ear 100 in the state in which the sound output device 1B is mounted on the ear 100, and a favorable mounted state to the ear 100 can be secured without causing discomfort.

<Conclusion>

As described above, in each of the sound output devices 1, 1A, and 1B, the speaker(s) 9, the housing(s) 2, and the ear pad portion(s) 3 are provided, the sound introduction hook 16 including the openings 7*b* is provided to the housing 2, the sound introduction hook 16 is to be mounted on the root portion of the auricle 101 from the helix 102 side, and the ear pad portion 3 is to be mounted on the root portion of the auricle 101 from the earlobe 112 side.

Therefore, the sound introduction hook 16 is to be mounted on the root portion of the auricle 101 from the helix 102 side, the ear pad portion 3 is to be mounted on the root portion of the auricle 101 from the earlobe 112 side, and the sound introduction hook 16 and the ear pad portion 3 are to be mounted on the ear 100 from substantially the opposite sides. Thus, a stable mounted state of the sound output device 1, 1A, or 1B on the ear 100 can be secured.

Further, since the sound introduction hook 16 and the ear pad portion 3 are formed into a continuous arc shape having substantially the same curvature, the sound introduction hook 16 and the ear pad portion 3 are formed into a shape that substantially coincides with the shape of the root portion of the auricle 101, and a stable mounted state to the ear 100 can be secured without causing discomfort.

Furthermore, since the ear pad portion 3 is formed of a material having a lower hardness than a hardness of the sound introduction hook 16, the sound introduction hook 16 to be mounted on the root portion of the auricle 101 from the helix 102 side has a higher hardness, and the ear pad portion 3 to be mounted on the root portion of the auricle 101 from the earlobe 112 side has a lower hardness.

Therefore, in the state in which each of the sound output devices 1, 1A, and 1B is mounted on the ear 100, the sound introduction hook 16 is difficult to deform, and an excessive load is not applied to the root portion of the auricle 101 from the ear pad portion 3, and a stable and favorable mounted state of each of the sound output devices 1, 1A, and 1B to the ear 100 can be secured.

Furthermore, in each of the sound output devices 1, 1A, and 1B, sound output from the speaker 9 is transmitted to the user via the sound introduction hook 16, and the sound introduction hook 16 is mounted in a state in which the tip portion thereof is not in contact with the ear 100, and thus it is possible to secure favorable recognizability of sound output from the speaker 9 and external sound and reduce the occurrence of discomfort in the mounted state.

Further, in each of the sound output devices 1, 1A, and 1B, sound output from the speaker 9 is introduced through the sound introduction space 16*a* of the sound introduction hook 16 and is recognized, and a bone conduction method in which vibration is transmitted to an ear bone to recognize sound is not employed. Therefore, reproducibility of a lower frequency band in a sound region is increased, and a low-pitched sound is easily heard.

Furthermore, since the tip portion of the sound introduction hook 16 does not come into contact with the ear 100 and the external auditory meatus 113 is not closed, it is possible to secure favorable reproducibility of low-pitched sound. In addition, the head-related transfer function is hardly changed, and thus it is possible to accurately recognize external sound.

Moreover, in a case where the openings 7*b*, 7*b* of the sound introduction hook 16 are positioned in the internal space 150 of the auricle 101 in a state in which each of the sound output devices 1, 1A, and 1B is mounted on the ear 100, the openings 7*b*, 7*b* are positioned close to the external auditory meatus 113, and thus it is possible to secure favorable recognizability of sound output from the speaker 9 and external sound.

Further, in a case where the openings 7*b*, 7*b* of the sound introduction hook 16 are positioned at the cavum conchae 114 in a state in which each of the sound output devices 1, 1A, and 1B is mounted on the ear 100, the openings 7*b*, 7*b* are positioned closer to the external auditory meatus 113, and thus it is possible to secure further favorable recognizability of sound output from the speaker 9 and external sound.

In addition, in a case where the openings 7*b*, 7*b* of the sound introduction hook 16 are positioned at the external auditory meatus 113 in a state in which each of the sound output devices 1, 1A, and 1B is mounted on the ear 100, the openings 7*b*, 7*b* are positioned close to the eardrum, and thus it is possible to secure still further favorable recognizability of sound output from the speaker 9 and external sound.

<Present Technology>

The present technology can have the following configurations.

(1)

A sound output device, including:

a speaker that outputs sound;

a housing that includes a sound introduction hook, the sound introduction hook having an internal space that is formed as a sound introduction space for introducing sound output from the speaker, the speaker being arranged in the housing; and an ear pad portion that is provided to be continuous to the housing, the sound introduction hook including an opening through which sound is emitted toward an ear, the sound introduction hook being to be mounted on a root portion of an auricle from a helix side, the ear pad portion being to be mounted on the root portion of the auricle from an earlobe side.

(2)

The sound output device according to (1), in which the opening is to be positioned in an internal space of the auricle.

(3)

The sound output device according to (2), in which the opening is to be positioned at a cavum conchae.

(4)

The sound output device according to any one of (1) to (3), in which the opening is formed on a side of the sound introduction hook, the side being to be faced to an external auditory meatus.

(5)

The sound output device according to any one of (1) to (4), in which a portion of the sound introduction hook that includes the opening is provided as a detachable portion that is detachable from another portion of the sound introduction hook.

(6)

The sound output device according to any one of (1) to (5), in which the sound introduction hook and the ear pad portion are formed into a continuous arc shape having substantially the same curvature.

(7)

The sound output device according to any one of (1) to (6), in which the ear pad portion is formed of a material having a lower hardness than a hardness of the sound introduction hook.

(8)

The sound output device according to any one of (1) to (7), in which the ear pad portion is elastically deformable with respect to the sound introduction hook.

(9)

The sound output device according to any one of (1) to (8), in which the portion of the sound introduction hook that includes the opening is not in contact with an ear in a state in which the sound introduction hook is mounted on the ear.

(10)

The sound output device according to any one of (1) to (9), in which a case body is arranged in the housing, and the speaker and a control board that controls the speaker are arranged in the case body.

(11)

The sound output device according to any one of (1) to (10), in which a pair of housings and a pair of sound introduction hooks are provided, and the speaker is arranged in each of the housings as a pair.

(12)

The sound output device according to (11), in which a control board is arranged in one of the housings, and a battery is arranged in the other one of the housings.

(13)

The sound output device according to (11) or (12), further including a band that couples the pair of housings to each other.

(14)

The sound output device according to (13), in which the band is formed into a belt-like shape.

(15)

The sound output device according to any one of (1) to (10), in which the single housing and the single sound introduction hook are provided, and a battery is arranged in the housing.

(16)

The sound output device according to any one of (1) to (15), in which a part of the housing is positioned in contact with a temporal region behind the auricle.

(17)

The sound output device according to any one of (1) to (16), in which the sound introduction hook is bendable.

REFERENCE SIGNS LIST

200 head
100 ear
101 auricle
102 helix
112 earlobe
150 internal space
113 external auditory meatus
114 cavum conchae
1 sound output device
2 housing
3 ear pad portion
4 band
7 detachable portion
**7*b*** opening
8 case body
9 speaker
10 control board
11 battery
16 sound introduction hook
**16*a*** sound introduction space
1A sound output device
1B sound output device

The invention claimed is:

1. A sound output device, comprising:

a pair of housings that includes a first housing and a second housing, wherein the first housing includes:

a sound introduction hook;

a case body that includes:

a first speaker configured to output sound; and a control board configured to control the first speaker, wherein the sound introduction hook includes an internal space, a first portion, and a second portion, and wherein the sound introduction hook further includes an inner circumferential side portion and an outer circumferential side portion, and a hardness of a material of the outer circumferential side portion is lower than a hardness of a material of the inner circumferential side portion, and the internal space of the sound introduction hook is a sound introduction space for introduction of the sound output from the first speaker; and a switch board, wherein the switch board includes a power supply switch and a plurality of volume control switches on an external surface of the switch board, the second housing includes a battery and a second speaker, and the second housing is different from the first housing; and an ear pad portion continuous to the first housing, wherein the first portion of the sound introduction hook includes an opening through which the sound is emitted toward an ear, the opening is in a direction orthogonal to a longitudinal direction of the first portion of the sound introduction hook, a thickness of the first portion is variable towards an end of the first portion, the end of the first portion is in contact with the second portion, the sound introduction hook is mounted on a root portion of an auricle from a helix side of the ear, and the ear pad portion is mounted on the root portion of the auricle from an earlobe side of the ear.

2. The sound output device according to claim 1, wherein the opening is in an internal space of the auricle.

3. The sound output device according to claim 2, wherein the opening is at a cavum conchae of the ear.

4. The sound output device according to claim 1, wherein the opening is on a side of the sound introduction hook, and the side faces an external auditory meatus of the ear.

5. The sound output device according to claim 1, wherein the first portion is detachable from the second portion of the sound introduction hook.

6. The sound output device according to claim 1, wherein a shape of each of the sound introduction hook and the ear pad portion is a continuous arc shape, and a curvature of the sound introduction hook is similar to a curvature of the ear pad portion.

7. The sound output device according to claim 1, wherein a hardness of a material of the ear pad portion is lower than a hardness of a material of the sound introduction hook.

8. The sound output device according to claim 1, wherein the ear pad portion is elastically deformable with respect to the sound introduction hook.

9. The sound output device according to claim 1, wherein the first portion of the sound introduction hook is not in contact with the ear based on the sound introduction hook that is mounted on the ear.

10. The sound output device according to claim 1, further comprising a pair of sound introduction hooks.

11. The sound output device according to claim 10, further comprising a band configured to couple the first housing of the pair of housings with the second housing of the pair of housings.

12. The sound output device according to claim 11, wherein a shape of the band is a belt-like shape.

13. The sound output device according to claim 1, wherein a part of the first housing is in contact with a temporal region behind the auricle.

14. The sound output device according to claim 1, wherein the sound introduction hook is bendable.

* * * * *